United States Patent [19]

Gray

[11] 4,189,927

[45] Feb. 26, 1980

[54] CONDENSER VACUUM LOAD COMPENSATING SYSTEM

[75] Inventor: Lewis Gray, Nether Providence, Pa.

[73] Assignee: Westinghouse Electric Corp., Pittsburgh, Pa.

[21] Appl. No.: 919,571

[22] Filed: Jun. 27, 1978

[51] Int. Cl.[2] ..... F01K 11/00

[52] U.S. Cl. ..... 60/687; 60/690

[58] Field of Search ..... 60/685, 687, 690

[56] References Cited

U.S. PATENT DOCUMENTS

| | | | |
|---|---|---|---|
| 1,780,476 | 11/1930 | Grace | 60/687 X |
| 1,781,107 | 11/1930 | Grace | 60/687 OR |
| 1,881,443 | 10/1932 | Flanders | 60/687 OR |

FOREIGN PATENT DOCUMENTS

| | | | |
|---|---|---|---|
| 1551192 | 4/1970 | Fed. Rep. of Germany | 60/690 |

*Primary Examiner*—Allen M. Ostrager
*Assistant Examiner*—Stephen F. Husar
*Attorney, Agent, or Firm*—J. Wikeen

[57] ABSTRACT

A support configuration between a turbine and associated condenser for compensating unbalanced pressure forces on the turbine with unbalanced pressure forces exerted on the condenser. A portion of the condenser floor is elevated above the remaining part of the condenser floor, is flexibly connected therewith, and constitutes a vacuum balance plate which is structurally connected to the turbine. Due to its flexible connection with the condenser, the vacuum balance plate is permitted limited displacement relative to the remaining portion of the condenser floor and can thus transmit unbalanced pressure forces exerted thereon through the structural members to the turbine so as to minimize the condenser vacuum load on the turbine's foundation. The vacuum balance plate's elevation is greater than the condenser's adjacent hot well floor and is preferably greater than the condenser's maximum condensate height. The balance plate is preferably convex to promote condensate drainage therefrom into the condenser's adjacent hot well. The balance of the condenser is flexibly connected to the turbine so as to permit relative movement therebetween. The optimum area for the vacuum balance plate is equal to the area of the turbine's exhaust port through which motive fluid is expelled into the condenser. By transmitting unbalanced pressure forces exerted on the condenser's vacuum balance plate to the turbine, the oppositely directed unbalanced pressure forces exerted on the turbine are substantially compensated resulting in minimized condenser vacuum load on the turbine's foundation.

6 Claims, 1 Drawing Figure

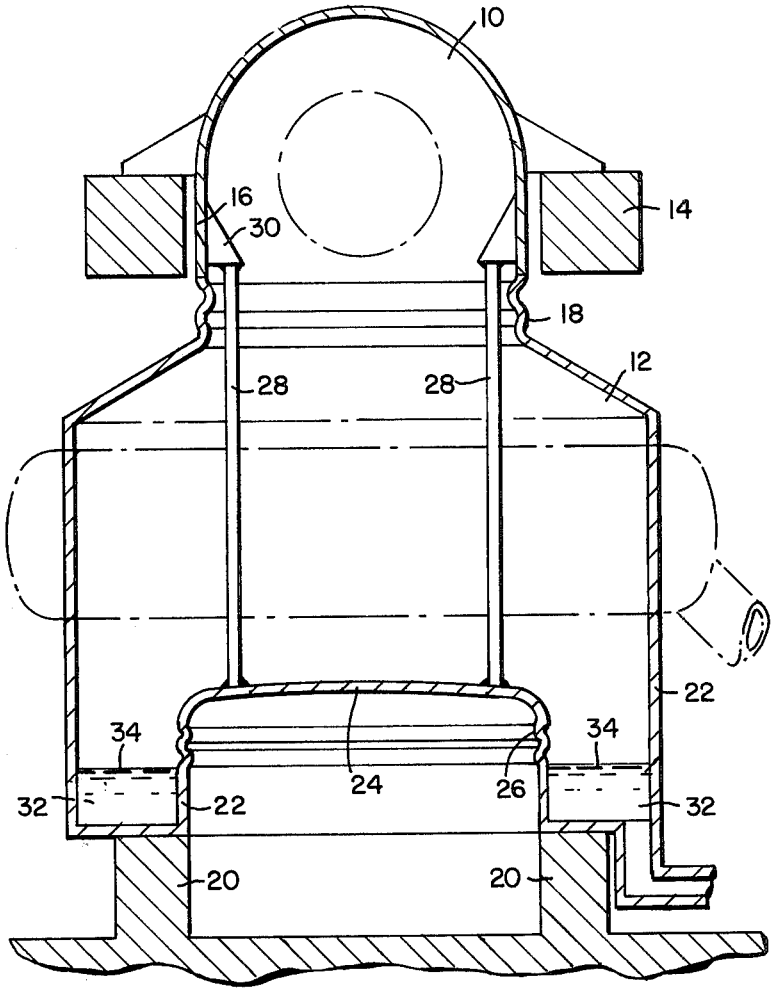
10
16
30
14
18
12
28
28
22
34
34
24
26
32
22
32
20
20

CONDENSER VACUUM LOAD COMPENSATING SYSTEM

BACKGROUND OF THE INVENTION

1. Field of the Invention

This invention relates to turbine-condenser configurations, and more particularly, to means for structurally connecting them so as to permit relative movement therebetween and minimize the condenser vacuum load on the turbine's supporting foundation.

2. Description of the Prior Art

The last stages in low pressure central station steam turbines typically operate at subatmospheric pressures and thus cause the turbine casing to be subjected to large atmospheric pressure forces which have commonly been balanced by the turbine's supporting structure. Subatmospheric pressure steam condensers for large central station applications are usually arranged beneath the low pressure turbines and their supporting structures and are connected to the low pressure turbines through flexible expansion joints which permit relative motion between the connected turbine and condenser while preventing atmospheric leakage into the condenser. The aforementioned condenser usually has its own support structure for bolstering the operating weight of the condenser and condensate accumulated therein. Such condensers normally have a net unbalanced pressure force directed toward the turbine in the upward direction, but that force is substantially reduced by the weight of the condensate which collects in the bottom or hot well of the condenser.

Traditionally, the support structure for large central station turbine generator units has consisted of reinforced concrete. In the past, there has generally been insufficient incentive for using alternate types of foundation structure, either to effect cost savings or to reduce foundation size and weight. Recently, however, a new concept in central station power generation has evolved. The new concept includes launching large sea-going vessels containing power generation equipment, such as turbines, condensers, etc. Support of such turbines necessitates use of relatively lightweight structures such as steel or other high strength structural components. As such, it has become important to minimize the size and weight of such turbine supporting structures while maintaining the supportive capabilities necessary to bolster large central station turbines and associated apparatus.

Copending Westinghouse Electric U.S. Pat. No. 4,189,926 which was filed June 15, 1978, and whose Ser. No. is 915,690, illustrates a vacuum balance chamber having an internal and an external wall with the external wall providing flexing capability and the internal wall preventing intrusion into the chamber of liquid condensate. Since the outer wall flexes in the copending patent application, the structural support columns which connect the outer wall to the turbine must pass through the vacuum balance chamber's inner wall and must be provided with means for preventing condensate intrusion into the chamber. A disadvantage of the aforementioned structure is the undesirable possibility of accumulating condensate within the vacuum balance chamber. Such condensate accumulation can adversely affect the pressure force balancing dynamics and may necessitate supplementary condensate drains from the vacuum balance chamber. Additional disadvantages of the copending patent application include the necessity for maintaining fluid communication from within the condenser or turbine exhaust neck to the vacuum balance chamber, the relatively high structural support columnar strength required, and the increased height requirements of the condenser when the aforementioned configuration is utilized. The copending application's vacuum balance chamber's expansion joint can, under certain foundation conditions, be difficult to assemble and relatively inaccessible for inspection and maintenance. Additionally, the goal of providing a good liquid seal between the vacuum balance chamber's inner wall and the intersecting structural support columns and the goal of permitting free, unrestrained movement therebetween are difficult to simultaneously achieve and can result in some sacrifice in one to satisfactorily obtain the other.

SUMMARY OF THE INVENTION

In accordance with the present invention, an improved turbine-condenser support configuration is provided for minimizing condenser vacuum loads on a turbine's support structure. The invention generally comprises a turbine which has an exhaust port for expelling motive fluid therethrough, a foundation for supporting the turbine, a condensing apparatus having a first enclosing portion including a floor with the first portion being flexibly connected to both the turbine and a second enclosing portion which is situated above the floor onto which condensate can accumulate, and means for structurally connecting the condenser's second enclosing portion to the turbine so as to transmit unbalanced pressure forces acting on the second enclosing portion to the turbine and thus minimize the condenser vacuum load on the turbine's foundation.

In a preferred embodiment of the present invention, the condenser's second enclosing portion is disposed parallel to, on the opposite side of the condenser from, and with an area substantially equal to that of the turbine's exhaust port. The second enclosing portion is preferably situated horizontally above the condensate's maximum accumulator height and has a shape, when viewed from the condenser's interior, which is convex so as to provide increased rigidity and promote condensate drainage therefrom into the condenser's hot well portion. During normal operation of the turbine and condenser, a vacuum is developed within the condenser with unbalanced pressure forces acting on the turbine in a first direction and acting on the condenser's second enclosing portion in a second, opposing direction. The unbalanced pressure force exerted on the second enclosing portion is transmitted to the turbine via structural members securely fastened to both so as to substantially compensate for unbalanced pressure forces exerted on the turbine and thus on the turbine's foundation. Maximum force transmission from the second enclosing portion or vacuum balance plate obtains when no other force, such as condensate weight, acts on the vacuum balance plate. To insure condensate drainage therefrom, the vacuum balance plate is elevated above the condenser's floor and is convex, or dome-shaped, to prevent any substantial condensate accumulation thereon. Elevation of the vacuum balance plate above the condenser's floor results in a minimum height condenser which permits utilizing shorter, and thus less substantial, structural support column members, decreased support complexity, and simpler installation and access to the flexible joint between the first and second condenser enclosing portions. Such structure utilizes less condenser material, smaller structural supports, smaller turbine foundation size, and decreased condenser spatial requirements.

BRIEF DESCRIPTION OF THE DRAWINGS

The invention will be more fully understood from the following detailed description of a preferred embodiment, taken in connection with the accompanying drawings, in which:

Sole FIGURE is a transverse, partial sectional view of an exemplary turbine and associated condenser incorporating a structural support system therebetween.

DESCRIPTION OF THE PREFERRED EMBODIMENT

Referring now to the drawing in detail, sole FIGURE shows a partial, transverse sectional view of a turbine 10 and associated condenser 12 into which turbine 10 exhausts motive fluid. For purposes of illustration, turbine 10 is considered to be an axial flow steam turbine and condenser 12 is considered to be a steam condenser.

Large central station turbines and condensers typically assume the general arrangement illustrated in the sole FIGURE with the exhaust end of turbine 10 and condenser 12 normally operating at subatmospheric pressure. Turbine 10 is usually almost entirely supported by foundation structure 14 which, according to the prior art, compensated for the turbine's weight and operational loads as well as the unbalanced pressure forces acting on the turbine. Exhaust neck 16 of turbine 10 is joined to condenser 12 by an expandable, flex joint 18 connected therebetween. Flex joint 18 is commonly used to permit limited relative movement between turbine 10 and condenser 12. Condenser 12, as illustrated, is primarily supported by foundation supports 20 which bear the weight of condenser 12 and the condensate which operationally collects on the condenser's floor or hot well.

The sole FIGURE illustrates condenser enclosing portions 22 and 24 which are flexibly joined by expandable flex joint 26, which permits relative movement therebetween. Enclosing portion 24 or vacuum balance plate is, by example, connected to turbine exhaust neck 16 by structural connecting members 28 whose size, number, and distribution are dependent on the particular application and the relative positioning between turbine 10 and condenser 12. Structural connecting members 28 are illustrated as being joined to exhaust neck 16 by braces 30, but it is to be understood that connecting members 28 may be attached directly to any portion of turbine 10.

As illustrated in sole FIGURE, vacuum balance plate 24 is elevated above the floor of condenser 12 and forms, when viewed from beneath condenser 12, a recessed structure. Condensate drainage from vacuum balance plate 24 into condenser 12's hot well 32 is promoted by the convexly-shaped vacuum balance plate 24. Vacuum balance plate 24 is elevated above the bottom of hot well 32 for a distance greater than the maximum condensate level 34 which is to be accumulated. Not only is assembly and maintenance of flex joint 26 simplified by the recessed structure, but the height of condenser 12 remains substantially the same as conventional power plant condensers and the length of structural connecting members 28 is minimized. The convex shape (as viewed from within condenser 12) of vacuum balance plate 24 prevents condensate accumulation thereon and thus promotes maximum unbalanced pressure force transmission from vacuum balance plate 24 through structural connecting members 28 to turbine 10 so as to reduce the downwardly directed unbalanced pressure forces exerted on turbine foundation structure 14 by turbine 10. To insure substantial equality between unbalanced pressure forces generated on turbine 10 and unbalanced pressure forces exerted on vacuum balance plate 24, the area of vacuum balance plate 24 is chosen to be generally equal to the area of the turbine's exhaust port which is bounded by the turbine exhaust neck 16.

It is to be understood that the disclosed structural connecting members 28 may assume any shape and size which are suitable for the particular application in which they are to be used. It is to be further understood that the teachings of the present invention allow condenser 12 to assume any shape in which vacuum balance plate 24 is generally disposed above the condenser's floor and preferably above the maximum condensate level permitted to accumulate.

It will now be apparent that a turbine-condenser configuration and supporting arrangement therebetween has been provided in which the turbine supports 14 have less strenuous strength requirements imposed thereon than heretofore with little additional structural complexity. While the connecting members 28 are illustrated as structurally tying together turbine 10 and vacuum balance plate 24, connection of the vacuum balance plate 24 and turbine supports 14 are also considered as being within the scope of the instant invention.

I claim:

1. A turbine-condenser support configuration comprising:

a turbine having an exhaust port for exhausting motive fluid therethrough;

a foundation structure for supporting said turbine;

a condensing apparatus for condensing motive fluid, said condensing apparatus being in fluid communication with said exhaust port and having first and second enclosing portions, said first portion being flexibly connected to said turbine and said second portion, said first portion including a floor, said second portion being disposed above the floor; and means for structurally connecting said second enclosing portion to said turbine so as to reduce the operational load on said turbine foundation.

2. The support configuration of claim 1 wherein said second enclosing portion is disposed on the opposite side of said condenser from said exhaust port.

3. The support configuration of claim 1 wherein said second enclosing portion is disposed above the floor a distance greater than the maximum height to which condensate can accumulate.

4. The support configuration of claim 1 wherein said second enclosing portion is disposed substantially horizontally and is, when viewed from the condenser's interior, convex in shape so as to promote condensate drainage therefrom.

5. The support configuration of claim 4 wherein said second enclosing portion is substantially centered in the condenser when viewed from above with the condenser's floor being disposed thereabout and below the second enclosing portion.

6. The support configuration of claim 1 wherein said second portion's area is substantially equal to the exhaust port's area.

* * * * *